US007185640B2

(12) United States Patent
Shears et al.

(10) Patent No.: US 7,185,640 B2
(45) Date of Patent: Mar. 6, 2007

(54) INTEGRATED FUEL TANK AND VAPOR CONTAINMENT SYSTEM

(75) Inventors: Peter D. Shears, Wauwatosa, WI (US); John Gulke, Fond du Lac, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/207,533

(22) Filed: Aug. 19, 2005

(65) Prior Publication Data

US 2006/0096584 A1 May 11, 2006

Related U.S. Application Data

(63) Continuation-in-part of application No. 10/981,894, filed on Nov. 5, 2004, now Pat. No. 7,086,390.

(51) Int. Cl.
*F02M 33/02* (2006.01)
*F02M 33/04* (2006.01)

(52) U.S. Cl. ..... 123/519; 123/520

(58) Field of Classification Search ..... 123/509, 123/516, 518, 519, 520; 137/565.17, 560
See application file for complete search history.

(56) References Cited

U.S. PATENT DOCUMENTS

| | | | |
|---|---|---|---|
| 1,499,864 | A | 7/1924 | Gordon |
| 2,358,840 | A | 9/1944 | Walker |
| 2,520,124 | A | 8/1950 | Chaney et al. |
| 2,553,763 | A | 5/1951 | Hammon |
| 2,822,059 | A | 2/1958 | Lunn et al. |
| 2,966,960 | A | 1/1961 | Rochlin |
| 3,221,724 | A | 12/1965 | Wentworth |
| 3,352,294 | A | 11/1967 | Biller et al. |
| 3,368,326 | A | 2/1968 | Hervert |

(Continued)

FOREIGN PATENT DOCUMENTS

| | | |
|---|---|---|
| DE | 4304180 | 8/1993 |

(Continued)

OTHER PUBLICATIONS

George A. Lavoie et al., "A Fuel Vapor Model (FVSMOD) for Evaporative Emissions System Design and Analysis," 1998 Society of Automotive Engineers, Inc.

(Continued)

*Primary Examiner*—Mahmoud Gimie
(74) *Attorney, Agent, or Firm*—Michael Best & Friedrich LLP

(57) ABSTRACT

A fuel tank for an engine that includes an air cleaner assembly and an air-fuel mixing device. The fuel tank includes a first tank portion and a second tank portion connected to the first tank portion to define a fuel chamber. A canister is at least partially formed as part of the second tank portion and a first flow path is at least partially formed as part of the first tank portion. The first flow path provides fluid communication between the fuel chamber and the canister. A second flow path is at least partially formed as part of the second tank portion to provide fluid communication between the canister and at least one of the air-fuel mixing device and the air cleaner assembly.

24 Claims, 13 Drawing Sheets

U.S. PATENT DOCUMENTS 3,372,679 A 3/1968 Aitken
3,391,679 A 7/1968 Williams et al.
3,406,501 A 10/1968 Watkins
3,456,635 A 7/1969 Hervert
3,477,210 A 11/1969 Hervert
3,541,765 A 11/1970 Adler et al.
3,542,095 A * 11/1970 Hammond et al. ..... 30/381
3,572,013 A 3/1971 Hansen
3,572,014 A 3/1971 Hansen
3,610,220 A 10/1971 Yamada
3,610,221 A 10/1971 Stoltman
3,617,034 A 11/1971 Skinner
3,645,244 A 2/1972 Seyfarth
3,646,731 A 3/1972 Hansen
3,650,256 A 3/1972 Marshall
3,665,906 A 5/1972 De Palma
3,675,634 A 7/1972 Tatsutomi
3,678,663 A * 7/1972 Hansen ..... 96/141
3,681,899 A 8/1972 Grote
3,696,799 A 10/1972 Gauck
3,721,072 A 3/1973 Clapham
3,747,303 A 7/1973 Jordan
3,757,753 A 9/1973 Hunt
3,759,234 A 9/1973 Buckton et al.
3,845,557 A * 11/1974 Bailey ..... 30/381
3,849,093 A 11/1974 Konishi et al.
3,910,302 A * 10/1975 Sudhir ..... 137/43
3,913,545 A 10/1975 Haase et al.
3,990,419 A 11/1976 Itakura
4,112,898 A 9/1978 Takimoto et al.
4,127,097 A 11/1978 Takimoto
4,175,526 A 11/1979 Phelan
4,259,096 A 3/1981 Nakamura et al.
4,261,717 A 4/1981 Belore et al.
4,279,233 A 7/1981 Tobita et al.
4,279,630 A 7/1981 Nakamura et al.
4,280,360 A 7/1981 Kobayashi et al.
4,375,204 A 3/1983 Yamamoto
4,415,344 A 11/1983 Frost et al.
4,418,662 A 12/1983 Engler et al.
4,446,838 A 5/1984 Suzuki et al.
4,475,522 A 10/1984 Oonaka
4,629,479 A 12/1986 Cantoni
4,631,077 A 12/1986 Spicer et al.
4,631,952 A 12/1986 Donaghey
4,658,795 A 4/1987 Kawashima et al.
4,684,382 A 8/1987 Abu-Isa
4,684,510 A 8/1987 Harkins
4,705,007 A 11/1987 Plapp et al.
4,747,388 A 5/1988 Tuckey
4,758,460 A 7/1988 Spicer et al.
4,852,761 A 8/1989 Turner et al.
4,919,103 A * 4/1990 Ishiguro et al. ..... 123/514
4,938,787 A 7/1990 Simmerlein-Erlbacher
5,197,426 A * 3/1993 Frangesch et al. ..... 123/198 E
5,215,132 A 6/1993 Kobayashi
5,221,573 A 6/1993 Baigas, Jr.
5,226,397 A 7/1993 Zabeck et al.
5,259,412 A 11/1993 Scott et al.
5,261,439 A 11/1993 Harris
5,301,829 A 4/1994 Chrisco
5,313,977 A 5/1994 Bergsma et al.
5,313,978 A 5/1994 Takaki
5,326,514 A 7/1994 Linden et al.
5,338,253 A 8/1994 Damsohn et al.
5,350,444 A 9/1994 Gould et al.
5,408,977 A 4/1995 Cotton
5,424,036 A 6/1995 Ushikubo
5,437,701 A 8/1995 Townsley
5,453,118 A 9/1995 Heiligman
5,478,379 A 12/1995 Bevins
5,560,345 A 10/1996 Geyer et al.
5,562,084 A 10/1996 Shimamura
5,566,705 A 10/1996 Harris
5,573,811 A 11/1996 Townsley
5,623,911 A 4/1997 Kiyomiya et al.
5,638,786 A 6/1997 Gimby
5,704,337 A 1/1998 Stratz et al.
5,727,531 A 3/1998 Osanai
5,762,692 A 6/1998 Dumas et al.
5,798,270 A 8/1998 Adamczyk, Jr. et al.
5,809,976 A 9/1998 Cook et al.
5,871,569 A 2/1999 Oehler et al.
5,875,768 A 3/1999 Schenk et al.
5,878,729 A 3/1999 Covert et al.
5,891,207 A 4/1999 Katta
5,898,107 A 4/1999 Schenk
5,901,689 A 5/1999 Kimura et al.
5,912,368 A 6/1999 Satarino et al.
5,935,398 A 8/1999 Taniguchi et al.
6,102,085 A 8/2000 Nanaji
6,105,708 A 8/2000 Amano et al.
6,136,075 A 10/2000 Bragg et al.
6,152,996 A 11/2000 Linnersten et al.
6,156,089 A 12/2000 Stemmer et al.
6,182,693 B1 2/2001 Stack et al.
6,189,516 B1 2/2001 Hei Ma
6,231,646 B1 5/2001 Schweizer et al.
6,237,574 B1 5/2001 Jamrog et al.
6,269,802 B1 8/2001 Denis et al.
6,273,070 B1 8/2001 Arnal et al.
6,302,144 B1 10/2001 Graham et al.
6,330,879 B1 12/2001 Kitamura et al.
6,354,280 B1 3/2002 Itakura et al.
6,367,458 B1 4/2002 Furusho et al.
6,390,074 B1 5/2002 Rothamel et al.
6,395,048 B1 5/2002 Yoder et al.
6,457,458 B1 * 10/2002 Frank et al. ..... 123/509
6,463,915 B2 * 10/2002 Ozaki et al. ..... 123/519
6,464,761 B1 10/2002 Bugli
6,505,610 B2 1/2003 Everingham et al.
6,591,866 B2 7/2003 Distelhoff et al.
6,595,167 B2 7/2003 Kaesgen
6,675,780 B1 1/2004 Wendels et al.
6,692,551 B2 2/2004 Wernholm et al.
6,692,555 B2 2/2004 Oda et al.
6,699,310 B2 3/2004 Oda et al.
6,729,312 B2 5/2004 Furushou
6,729,319 B2 5/2004 Mitsutani
6,736,871 B1 5/2004 Green et al.
6,758,885 B2 7/2004 Leffel et al.
6,772,740 B2 8/2004 Kojima et al.
6,779,512 B2 8/2004 Mitsutani
6,786,207 B2 9/2004 Kojima et al.
6,863,082 B1 2/2005 McIntosh et al.
6,874,484 B2 4/2005 Benjey
6,874,485 B2 4/2005 Fujimoto
6,877,488 B2 4/2005 Washeleski
6,892,711 B2 5/2005 Belanger, Jr. et al.
6,959,696 B2 11/2005 Shears et al.
6,976,477 B2 12/2005 Gimby et al.
2005/0005917 A1 1/2005 Veinotte
2005/0133096 A1 * 6/2005 Brunel et al. ..... 137/565.17
2005/0178368 A1 8/2005 Donahue et al.
2005/0284450 A1 * 12/2005 Mills ..... 123/519

FOREIGN PATENT DOCUMENTS

EP 0 611896 8/1994
EP 1110593 6/2001

| | | |
|---|---|---|
| GB | 2082935 | 3/1992 |
| JP | 54141916 | 11/1979 |
| JP | 0067960 | 4/1983 |

OTHER PUBLICATIONS

H. Bauer.-ed., "Gasoline-Engine Management," 1999, p. 152, Robert Bosch GmbH.

H. Bauer.-ed., "Gasoline Engine Management," 1999, p. 288-289, Robert Bosch GmbH.

H. Bauer.-ed., "Gasoline Engine Management," 1999, pp. 343-345, Robert Bosch GmbH.

"Automotive Fuel Lines," Verlag Moderne Industie, 1998, p. 4.

* cited by examiner

INTEGRATED FUEL TANK AND VAPOR CONTAINMENT SYSTEM

RELATED APPLICATION DATA

This application is a continuation-in-part of U.S. application Ser. No. 10/981,894, filed Nov. 5, 2004, now U.S. Pat. No. 7,086,390, the entire contents of which are incorporated herein by reference.

BACKGROUND

The present invention relates to a vapor containment system, and particularly to a vapor containment system that is at least partially formed as part of a fuel tank.

Internal combustion engines are often used to power small equipment such as lawnmowers, tillers, snow throwers, and the like. Typically, these engines include a fuel system that supplies fuel for combustion. The fuel system includes a tank, in which fuel is stored for use. Generally, the volatility of the fuel allows a portion of the fuel to evaporate and mix with air within the tank. Changes in temperature, such as those between evening and daytime, as well as sloshing during use can cause an increase or a decrease in the amount of fuel vapor in the tank as well as an increase or a decrease in the pressure within the tank.

To accommodate these pressure changes, fuel tanks often include a vent such as a vented fuel cap. The vent allows the excess air and fuel vapor to escape the tank when the pressure increases, and also allows air to enter the tank when the pressure drops. Pressure within the fuel tank typically drops as fuel is drawn from the tank for use. However, the escape of fuel vapor reduces the fuel efficiency of the engine.

SUMMARY

The invention provides a fuel tank for an engine that includes an air cleaner assembly and an air-fuel mixing device. The fuel tank includes a first tank portion and a second tank portion connected to the first tank portion to define a fuel chamber. A canister is at least partially formed as part of the second tank portion and a first flow path is at least partially formed as part of the first tank portion. The first flow path provides fluid communication between the fuel chamber and the canister. A second flow path is at least partially formed as part of the second tank portion to provide fluid communication between the canister and at least one of the air-fuel mixing device and the air cleaner assembly.

The invention also provides a fuel tank that includes a first tank portion and a second tank portion connected to the first tank portion to define a fuel chamber. A valve chamber is at least partially formed as part of the first tank portion and a valve member is disposed at least partially within the valve chamber. A canister is at least partially formed as part of the second tank portion and a filter media is positioned within the canister and is operable to adsorb fuel vapor.

The invention further provides a fuel tank for an engine that includes an air cleaner assembly and an air-fuel mixing device. The fuel tank includes a wall that defines a fuel chamber and a valve chamber that is at least partially formed as part of the wall. A first fluid communication path is at least partially formed as part of the wall to provide fluid communication between the fuel chamber and the valve chamber. A canister at least partially defines a canister space and a second fluid communication path is positioned to provide fluid communication between the valve chamber and the canister space. A third fluid communication path is at least partially formed as part of the wall to provide fluid communication between the canister space and the air-fuel mixing device and a fourth fluid communication path is at least partially formed as part of the wall to provide fluid communication between the canister space and the air cleaner assembly.

BRIEF DESCRIPTION OF THE DRAWINGS

The detailed description particularly refers to the accompanying figures in which.

DETAILED DESCRIPTION

Figure 1:
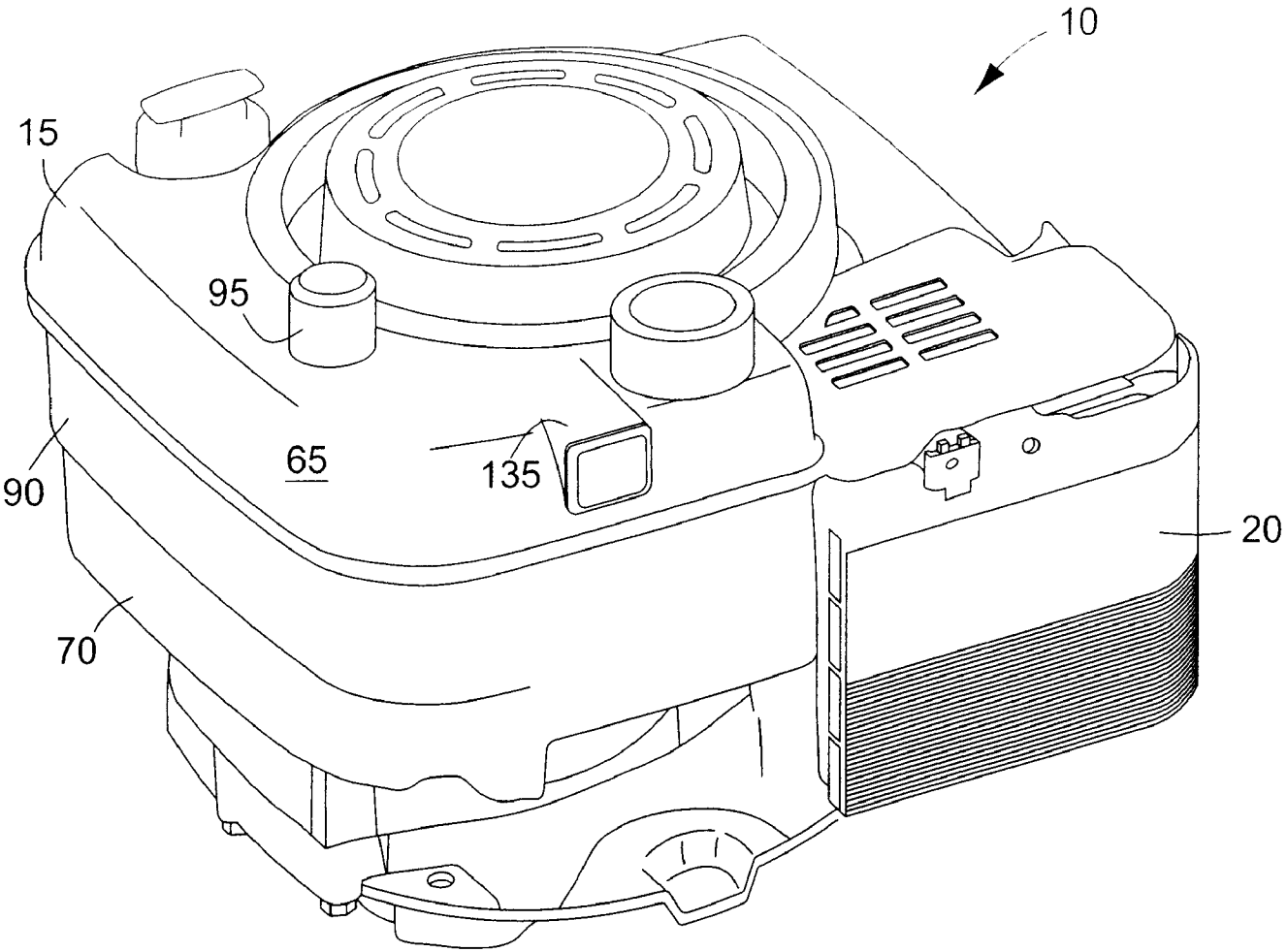
FIG. 1 is a perspective view of an engine including a fuel tank.

With reference to FIG. 1, an engine 10 including a fuel tank 15, an air cleaner assembly 20, and an air-fuel mixing device, such as a carburetor 25 (shown in FIG. 2) is illustrated. Engines 10 of this type are often used to power small equipment such as lawnmowers, garden tractors, snow throwers, tillers, pressure washers, generators, and the like. While the illustrated engine 10 is a small engine (e.g., two or fewer cylinders), it should be understood that the invention will function with other types of engines including large internal combustion engines.

The air cleaner assembly 20 receives a flow of air from the atmosphere and filters that air for delivery to the engine 10. Generally, a pleated paper filter media 30 is disposed within the air cleaner assembly 20 to filter unwanted particles form the air before the air is delivered to the air-fuel mixing device 25. Thus, the air cleaner assembly 20 defines a clean air space 35 where filtered air exits the filter media 30.

The carburetor 25 could be a float carburetor, a diaphragm carburetor or any other type of carburetor. The carburetor 25, illustrated in FIG. 2, includes a throttle plate (not shown) and a throat or venturi. The throttle plate controls the quantity of air that passes through the carburetor 25. As the air passes through the throat, fuel is drawn into the air stream and mixed with the air to produce a combustible air-fuel mixture. The air-fuel mixture is delivered to a combustion chamber 50 and combusted to produce usable power. A flow path may exist between the carburetor 25 and the combustion chamber 50. This flow path, if present, should be considered part of the carburetor 25.

The engine 10 includes one or more pistons 55 (shown schematically in FIGS. 9–11) that reciprocate within one or more cylinders 60 to define one or more combustion chambers 50. The illustrated engine 10 includes a single piston 55 that reciprocates within a single cylinder 60 to define a single combustion chamber 50. A spark ignites the air-fuel mixture within the combustion chamber 50 to produce useable shaft power at a crankshaft. Other types of engines (e.g., rotary engines, diesel engines, etc.) may define the combustion chamber in a different manner, or may ignite the air-fuel mixture in a different manner to produce the useable shaft power. In addition, other air-fuel mixing systems, including fuel injection, may be employed to deliver fuel and air to the combustion chamber 50.

Figure 3:
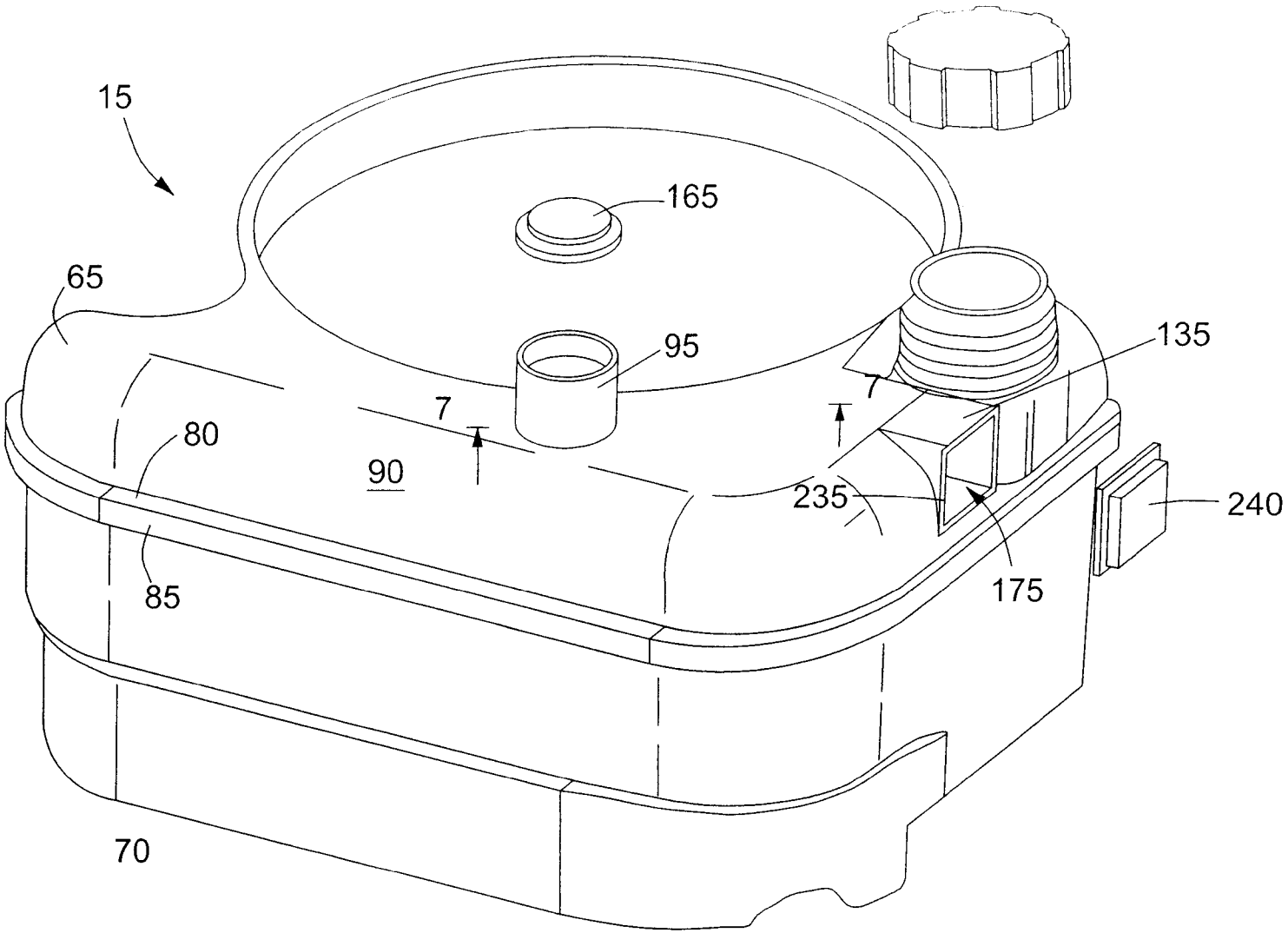
FIG. 3 is an exploded perspective view of the fuel tank of FIG. 1.
Figure 6:
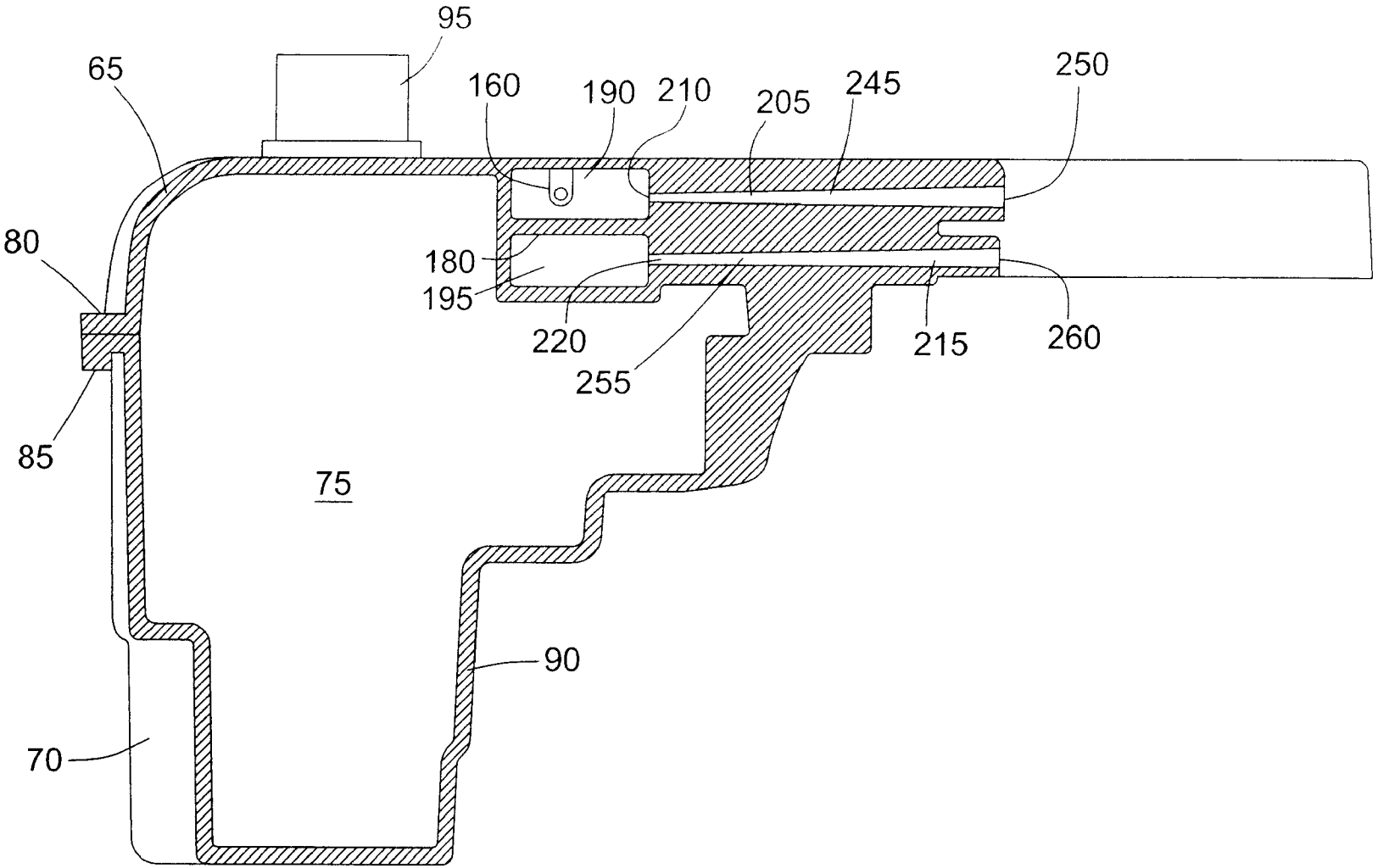
FIG. 6 is a section view the fuel tank of FIG. 4 taken along line 6—6 of FIG. 2.

With reference to FIG. 3, the fuel tank 15 includes a first tank portion 65 and a second tank portion 70 that attach to one another to define a fuel chamber 75 (shown in FIG. 6). The fuel chamber 75 receives and stores fuel for eventual use by the engine 10. The first tank portion 65 includes an attachment lip 80 that extends around the perimeter of the first tank portion 65. The second tank portion 70 includes a corresponding attachment lip 85 that extends around the perimeter of the second tank portion 70 and engages with the attachment lip 80 of the first tank portion 65 to completely define a wall 90 of the tank 15. In most constructions, the first tank portion 65 and the second tank portion 70 are welded to one another at the attachment lips 80, 85. In other constructions, an adhesive is used to attach the first tank portion 65 to the second tank portion 70.

The first tank portion 65 and the second tank portion 70 are generally injection molded from a plastic material. However, other manufacturing processes (e.g., vacuum forming, drawings, stamping, roto-molding, blow molding, and the like) may also be used to form one or both of the first tank portion 65 and the second tank portion 70. In addition, other materials, such as metals, composites, and the like may be employed to form one or both of the first tank portion 65 and the second tank portion 70 if desired.

In still another construction, a one-piece tank is formed using a suitable manufacturing process (e.g., roto-molding, injection molding, and the like). The one-piece tank eliminates the assembly step of attaching the first tank portion 65 to the second tank portion 70.

With continued reference to FIG. 3, the first tank portion 65 includes a valve chamber 95 that extends above the first tank portion 65. At least a portion of the valve chamber 95 is integrally-formed as part of the wall 90. As shown in FIG. 3, the valve chamber 95 is a substantially cylindrical chamber that is open at its uppermost end. While the valve chamber 95 has been described as extending above the first tank portion 65, other constructions may include valve chambers 95 that extend below the level of the first tank portion 65, or that extend above and below the wall 90 of the first tank portion 65.

A valve 100 (shown schematically in FIGS. 7 and 8) is disposed within the valve chamber 95 and is operable to inhibit over-filling of the fuel tank, inhibit fuel spillage due to sloshing and splashing, and inhibit fuel spillage during high tilt angle (e.g., greater than about 30 degrees) or rollover conditions. The valve 100 also allows free airflow through the valve chamber 95 during normal operating conditions, as will be described with regard to FIGS. 9–11. Many commercially available valves are well suited to performing these functions.

Figure 4:
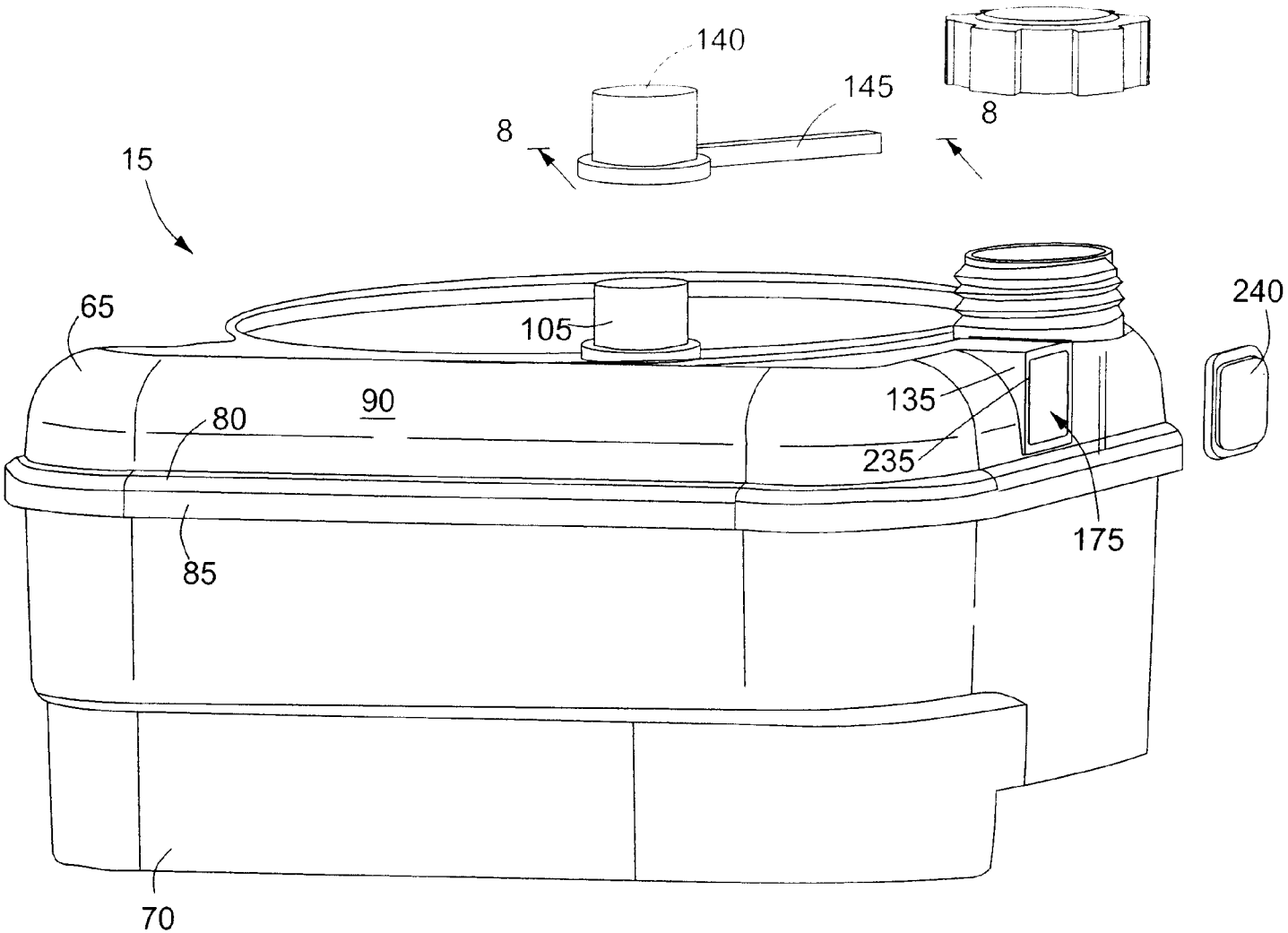
FIG. 4 is an exploded perspective view of another construction of a fuel tank.
Figure 7:
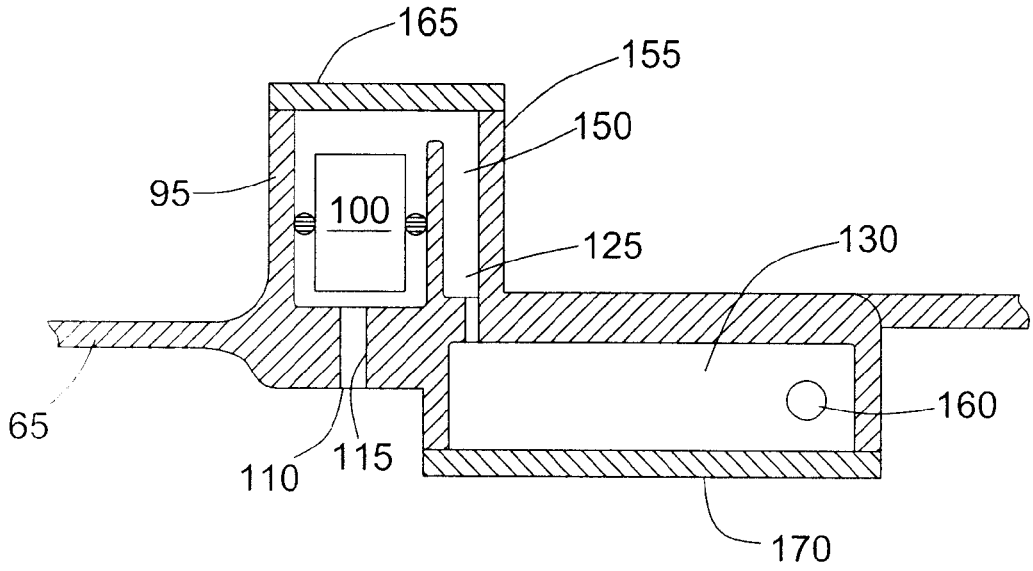
FIG. 7 is a sectional view of a portion of the fuel tank taken along line 7—7 of FIG. 3.
Figure 8:
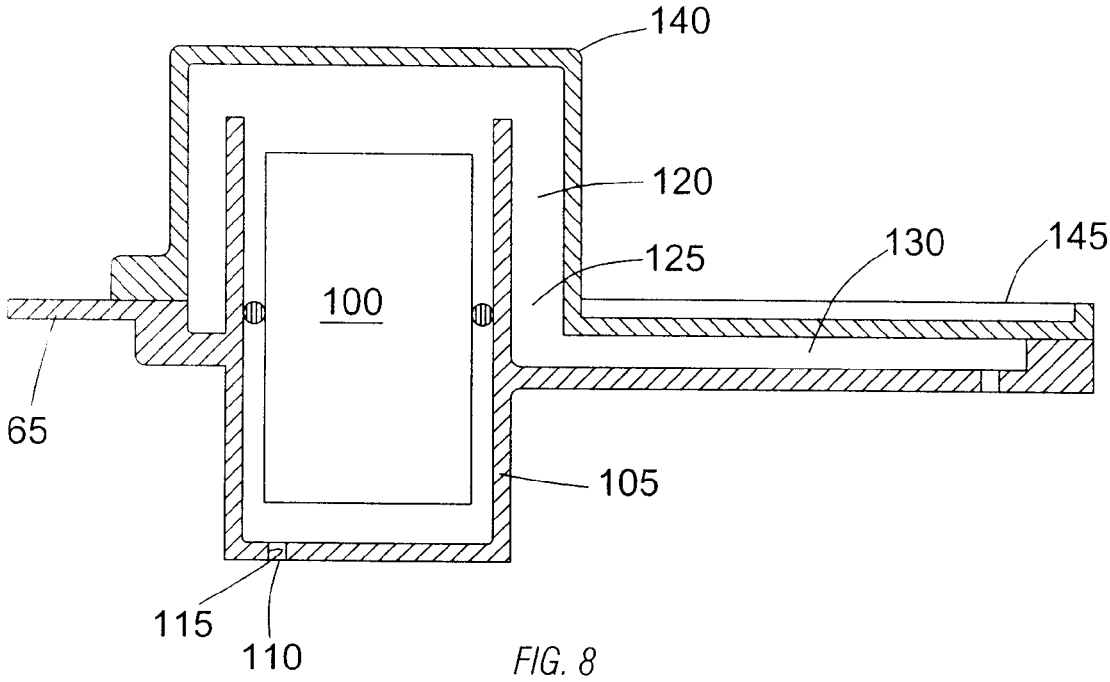
FIG. 8 is a sectional view of a portion of the fuel tank taken along line 8—8 of FIG. 4.

FIGS. 3 and 7 illustrate one valve chamber 95 that is suitable for use with the invention, while FIGS. 4 and 8 illustrate a second valve chamber 105 that is suitable for use with the invention. Of course other arrangements are possible and contemplated by the invention. The construction of FIGS. 4 and 8 includes the valve 100 disposed within the cylindrical valve chamber 105. A first flow path 110 is at least partially defined by an aperture 115 between the valve chamber 105 and the fuel chamber 75. The first flow path 110 allows for fluid communication between the valve chamber 105 and the fuel chamber 75. An annular chamber 120 surrounds the portion of the cylindrical valve chamber 105 disposed above the first tank portion 65 and defines a first end 125 of a second flow path 130. The second flow path 130 extends between the valve chamber 105 and a canister 135. A portion of the second flow path 130 is positioned on top of the top surface of the first tank portion 65 and is at least partially defined by the first tank portion 65. A cap 140 covers the portion of the valve chamber 105 that is disposed above the first tank portion 65. The cap 140 also includes an extension portion 145 that cooperates with the first tank portion 65 to enclose the second flow path 130 such that the second flow path 130 is open at the annular chamber 120 and at the canister 135 only. In most constructions, the cap 140 is welded or adhesively bonded to the first tank portion 65 to assure a substantially leak-free connection.

The arrangement of the valve chamber 95 illustrated in FIGS. 3 and 7 again includes the valve 100 disposed within the cylindrical valve chamber 95. A non-annular chamber 150 is disposed on one side of the valve chamber 95 and is partially defined by an outer wall 155 that is taller than the cylindrical valve chamber 95. The non-annular chamber 150 defines the first end 125 of the second flow path 130. A portion of the second flow path 130 is disposed beneath the top surface of the first tank portion 65 and is at least partially defined by the wall 90 of the first tank portion 65. A second end 160 of the second flow path 130 ends within the canister 135, as it does with the construction of FIGS. 4 and 8. A first cover 165 is welded or adhesively bonded to the wall 155 above the cylindrical valve chamber 95 to seal the chamber 95 and provide a flow path between the valve chamber 95 and the non-annular chamber 150. Thus, the second flow path 130 and the valve chamber 95 are in fluid communication. A second cover 170 is welded or adhesively bonded to the inside of the first tank portion 65 such that the second cover 170 and the first tank portion 65 cooperate to enclose the second flow path 130 between the non-annular chamber 150 and the canister 135.

While a non-annular chamber 150 has been shown and described, one of ordinary skill will realize that the actual shape of the chamber is not critical to the function of the invention. Thus, an annular chamber, a crescent-shaped chamber, or other shaped chambers could be employed if desired.

Figure 5:
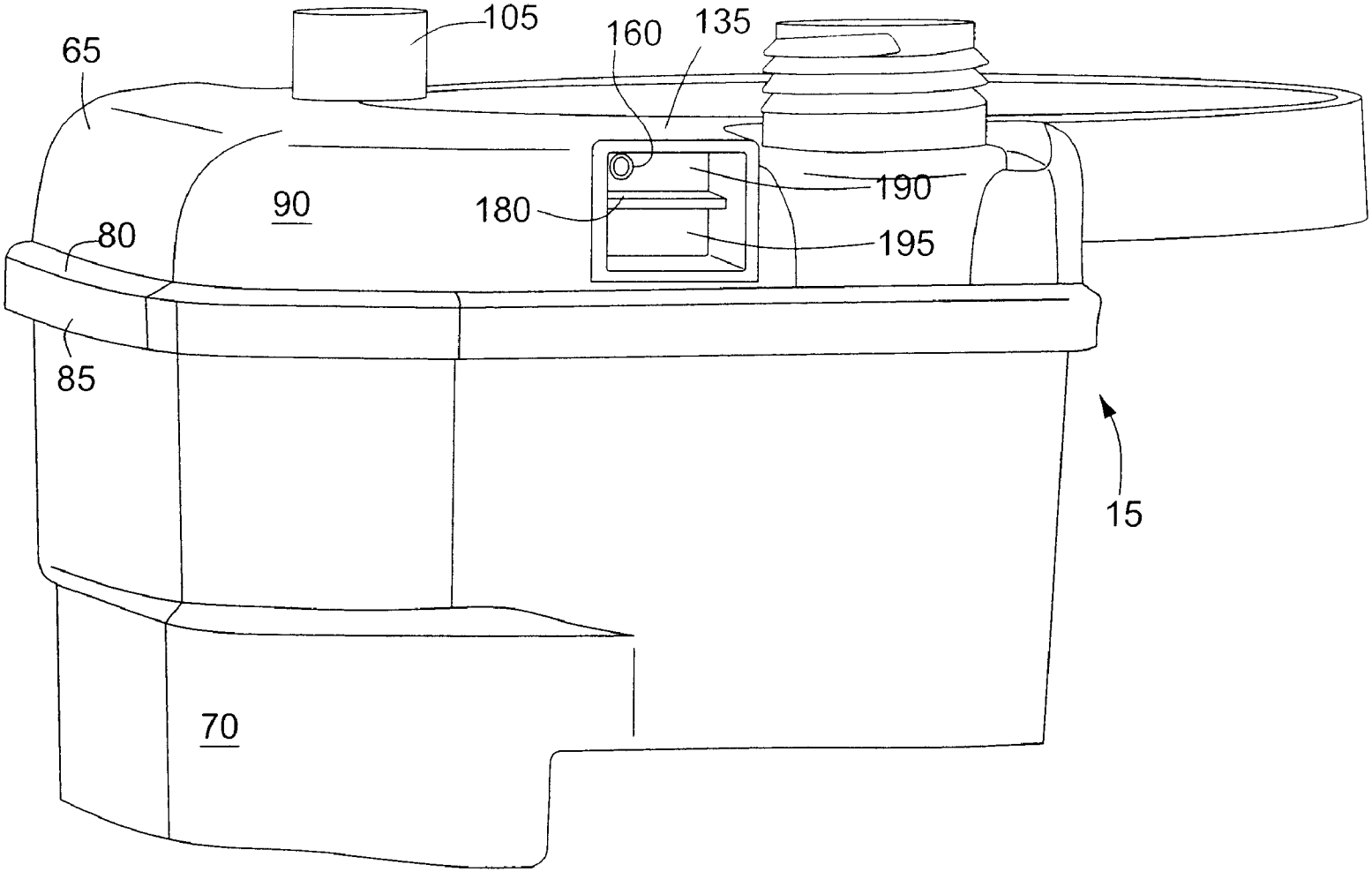
FIG. 5 is a perspective view of the fuel tank of FIG. 4.

The canister 135 is at least partially formed as part of the wall 90 of the fuel tank 15 and more specifically as part of the first tank portion 65. The canister 135, best illustrated in FIGS. 1 and 5, defines a canister space 175 that is separated by a central wall 180 into a U-shaped flow path 185 having a first leg 190 and a second leg 195. The first leg 190 of the U-shaped flow path 185 is disposed above the second leg 195, with other arrangements also being possible.

Figure 9:
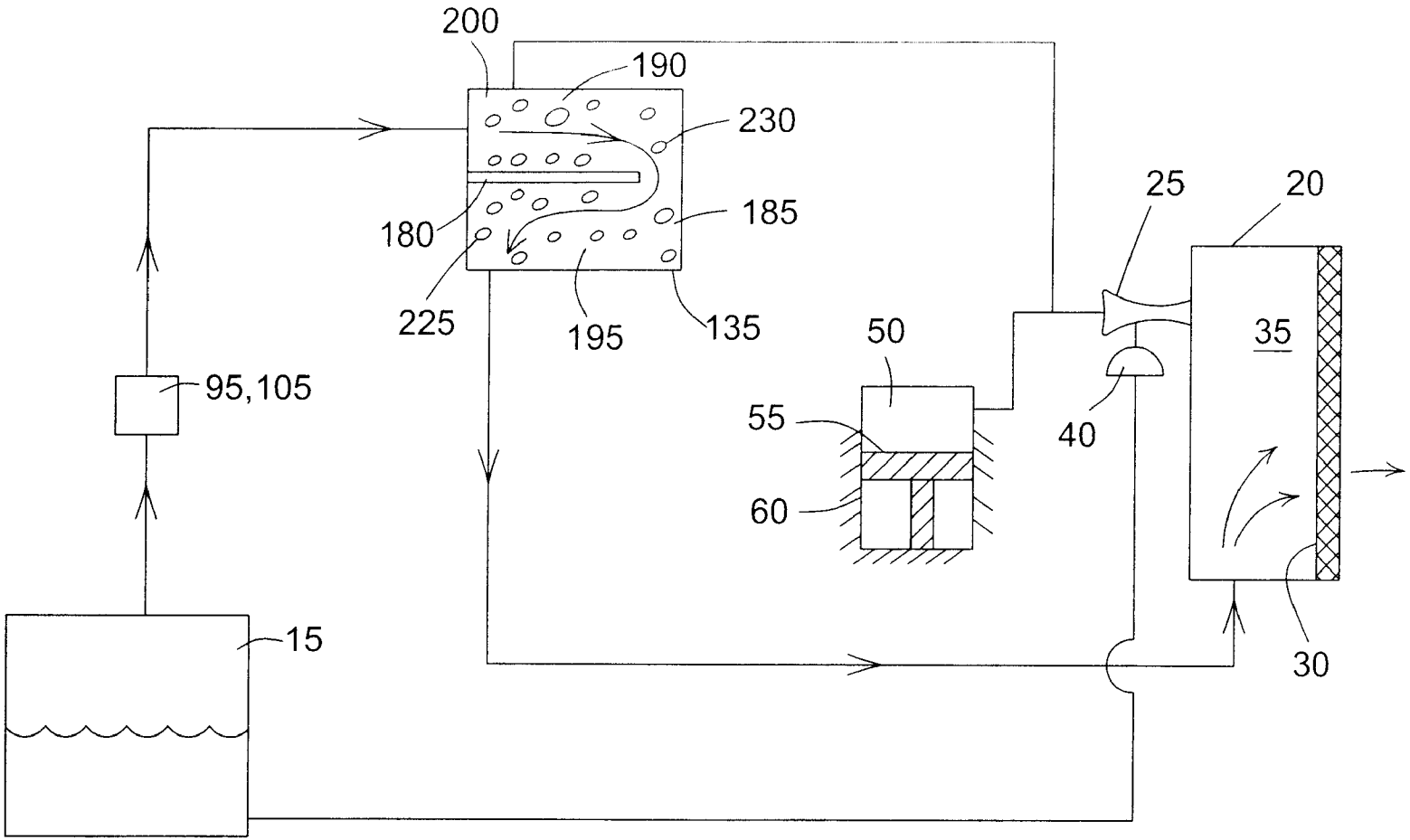
FIG. 9 is a schematic illustration of the vapor containment system during a pressure rise within the fuel tank when the engine is idle.
Figure 10:
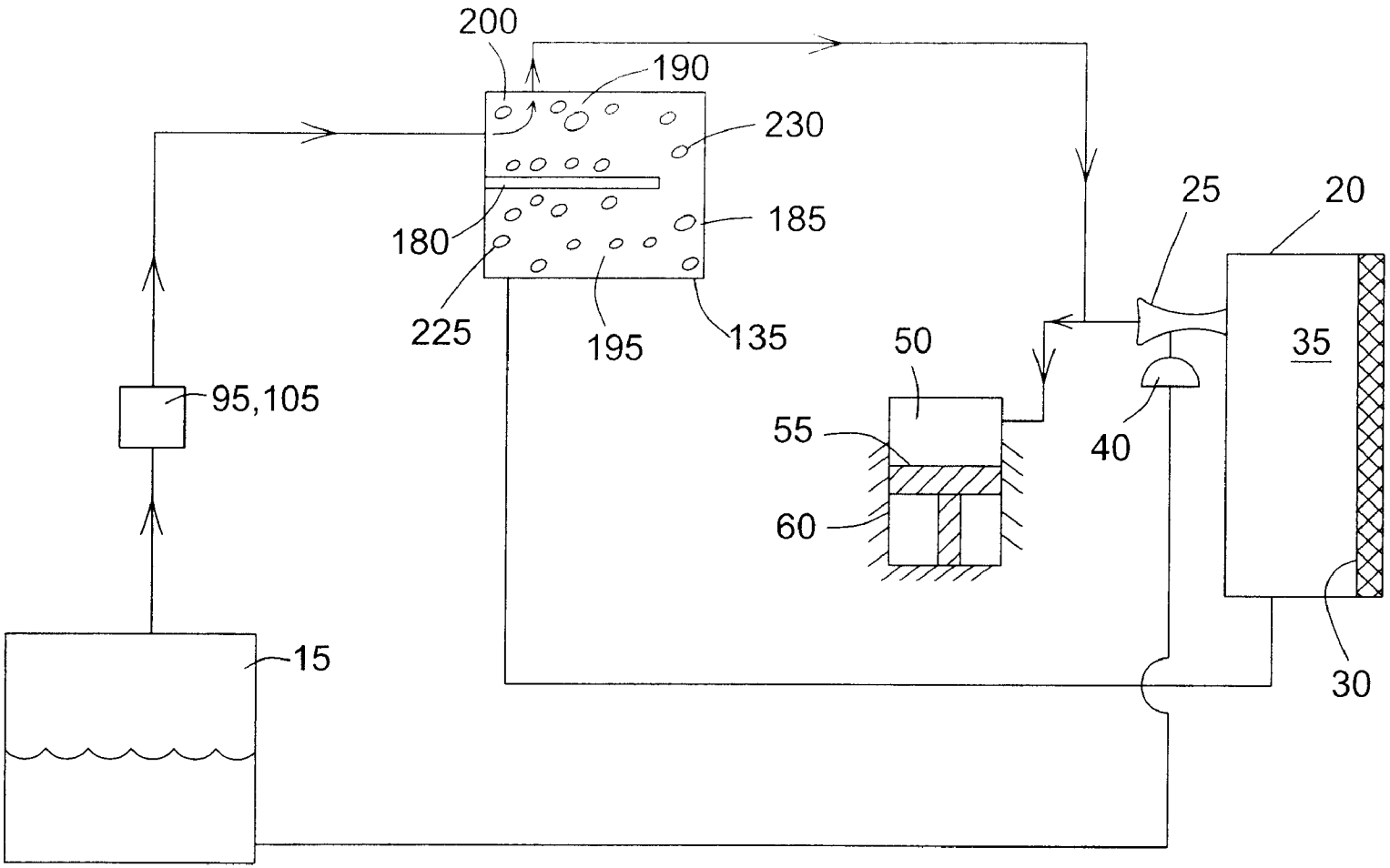
FIG. 10 is a schematic illustration of the vapor containment system during a pressure rise within the fuel tank when the engine is running.
Figure 11:
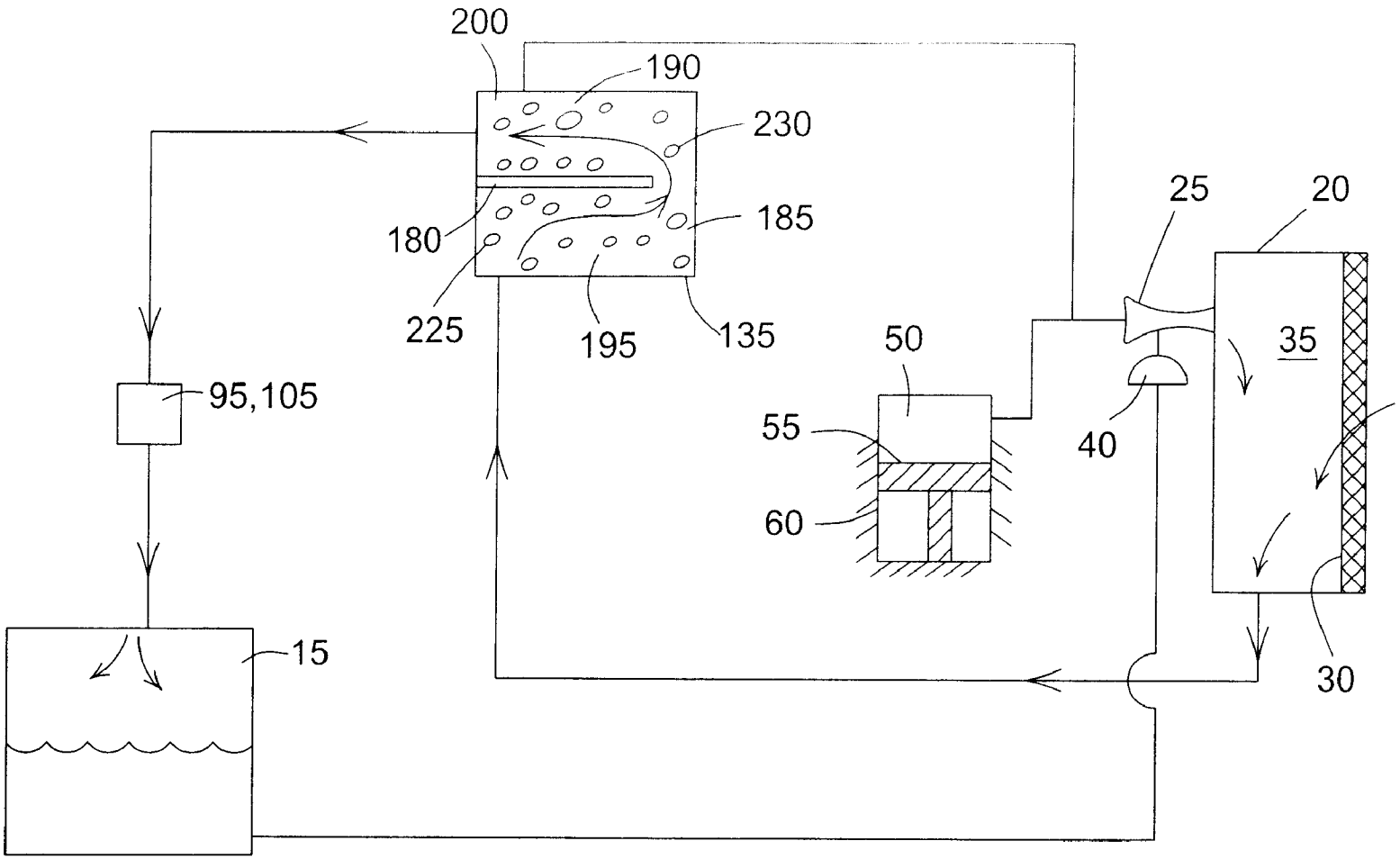
FIG. 11 is a schematic illustration of the vapor containment system during a pressure drop within the fuel tank.
Figure 12:
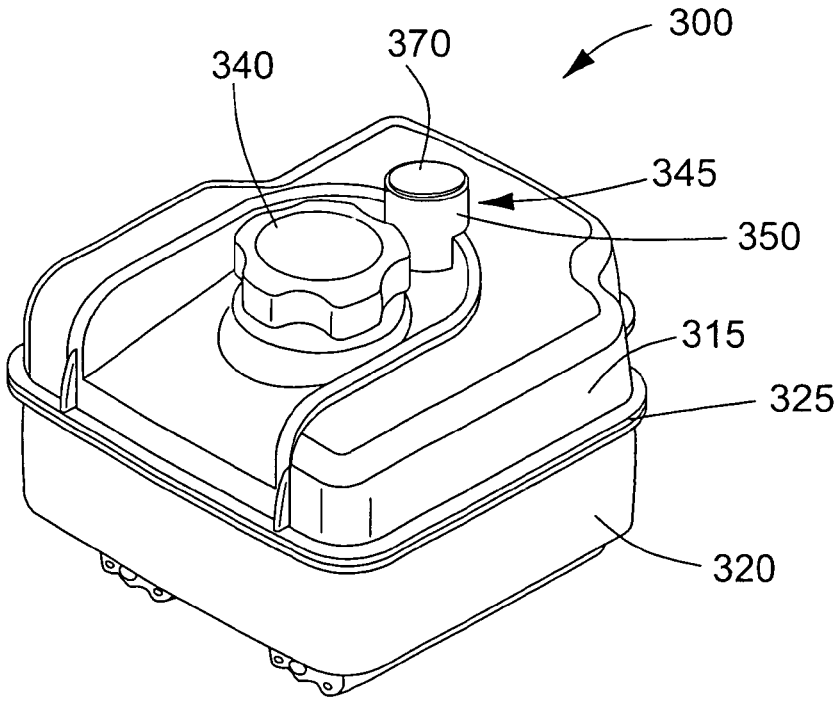
FIG. 12 is a perspective view of another construction of a fuel tank.

The canister space 175 is in fluid communication with three flow paths. The second end 160 of the second flow path 130, described with regard to FIGS. 3–4 and 7–8, is disposed near a first end 200 of the first leg 190. The first end 200 is opposite the bend in the U-shaped flow path 185, as illustrated in FIGS. 9–11. A third or purge flow path 205 includes a first end 210 that is positioned near the first end 200 of the first leg 190, and a fourth or vent flow path 215 includes a first end 220 that is positioned near a first end 225 of the second leg 195. Again, the first end 225 of the second leg 195 is opposite the bend in the U-shaped flow path 185, as illustrated in FIGS. 9–11. Thus, flow between the second flow path 130 and the third flow path 205 would travel a short distance along the first leg 190. However, flow between the second flow path 130 and the fourth flow path 215 must travel around a significant portion of the U-shaped flow path 185 within the canister space 175.

A filter media 230 that is suitable for use in filtering hydrocarbons is disposed within the U-shaped flow path 185. The filter media 230 adsorbs hydrocarbons, such as fuel vapor, that may be entrained in the flow that passes through the U-shaped flow path 185. One suitable filter media 230 is activated charcoal, with other types of filter media 230 also being suitable for use.

The canister space 175 includes an open end 235 that allows for access to the canister space 175 from outside of the fuel tank 15. The open end 235 allows the filter media 230 to be placed in the canister 135 after manufacturing of the fuel tank 15 is complete. A cover 240, shown in FIG. 4, is welded or adhesively bonded to the canister 135 to close the open end 235. In other constructions, fasteners or other fastening means are employed to attach the cover 240 to the open end 235.

FIG. 6 illustrates the canister 135 and portions of the third and fourth flow paths 205, 215 in section. The first end 210 of the third flow path 205 extends into the first leg 190 of the canister 135, as does the second end 160 of the second flow path 130. A passageway 245 extends from the first end 210 of the third flow path 205 to a passageway end point 250. The passageway 245 is formed as part of, or machined into, the first tank portion 65. The first end 220 of the fourth flow path 215 enters the canister 135 near the first end 225 of the second leg 195. A second passageway 255 extends from the first end 220 of the fourth flow path 215 to a second passageway end point 260. The second passageway 255 is formed as part of, or machined into, the first tank portion 65.

Figure 2:
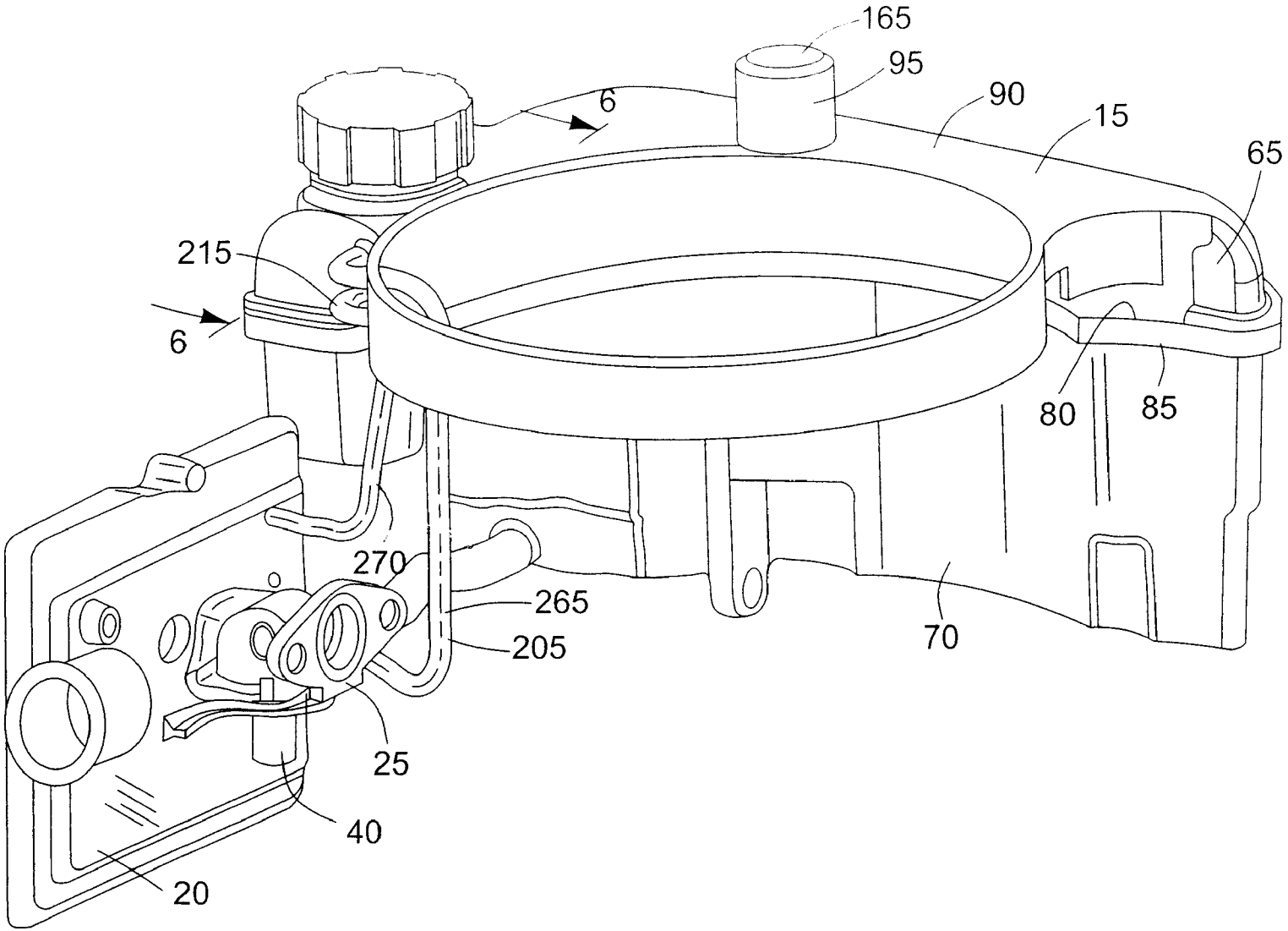
FIG. 2 is a perspective view of the fuel tank, a carburetor, and an air cleaner assembly of FIG. 1.

With reference to FIG. 2, the remainder of the third flow path 205 and the fourth flow path 215 are illustrated. A purge tube 265, or other flow-passing device, includes a first end that connects to the passageway end point 250 and facilitates the flow of fluids between the canister 135 and the carburetor 25. A second end of the purge tube 265 ends in the flow path between the carburetor 25 and the combustion chamber 50 such that, during engine operation, the second end of the purge tube 265 is generally maintained at a partial vacuum pressure. Thus, during engine operation, fluid is drawn toward the second end of the purge tube 265 along the third flow path 205.

A vent tube 270, or other flow device, includes a first end that connects to the second passageway end point 260 to facilitate the flow of fluid between the canister 135 and the air cleaner assembly 20. A second end of the vent tube 270 opens in the clean air space 35 such that fluid flowing to the air cleaner assembly 20 via the fourth flow path 215 can escape to the atmosphere. When the engine 10 is not running, the fluid enters or exits the clean air space 35. When exiting the clean air space 35 the flow passes through the filter media 30 of the air cleaner assembly 20 to enter the atmosphere.

The operation of the invention will be described with reference to FIGS. 9–11. In operation, a user fills the fuel tank 15 with fuel, usually gasoline, with other fuels also being possible. The volatility of the fuel allows some fuel to evaporate and fill the empty space within the tank 15 with a mixture of fuel vapor and air. Normal fluctuations in temperature (e.g., between the day and the evening), as well as fuel sloshing induced during use can cause an increase or a decrease in the amount of fuel vapor within the tank 15. These increases and decreases generally result in corresponding increases or decreases in pressure within the tank 15.

As shown in FIGS. 9 and 10, as the pressure within the tank 15 increases, a volatile fluid made up of fuel vapor and air enters the first flow path 110 between the fuel chamber 75 and the valve chamber 95, 105. The volatile fluid is free to pass through the valve 100 so long as the engine 10 is not tipped at an extreme angle (e.g., generally 30 degrees or greater) and the fuel chamber 75 has not been overfilled. After passing through the valve 100, the volatile fluid enters the second flow path 130 and flows to the canister 135. From the canister 135, the volatile fluid can follow two different flow paths depending on whether the engine 10 is running.

FIG. 9 illustrates the flow paths that are followed when the engine 10 is not running. The volatile fluid flows through the filter media 230 disposed along the U-shaped path 185 within the canister 135. The filter media 230 removes a substantial portion of, or all, the fuel vapor within the volatile fluid such that as the flow reaches the first end 220 of the fourth flow path 215, the flow is made up almost completely of air. The air enters the fourth flow path 215 and flows to the clean air space 35 defined by the air cleaner assembly 20. From the clean air space 35, the air can pass through the air cleaner assembly 20 to the atmosphere or can enter the carburetor 25 for combustion.

From the end of the second flow path 130, the flow can follow two possible flow paths. The first possible path, illustrated in FIG. 9, extends from the end of the second flow path 130, through the U-shaped path 185, and through the fourth flow path 215. A second possible path extends from the end of the second flow path 130, through a portion of the U-shaped flow path 185, and through the third flow path 205. It is desirable that the flow follow the first possible flow path such that the flow passes through the entire U-shaped flow path 185 and most or all of the fuel vapor is removed from the flow. If the flow of volatile fluid from the second flow path 130 followed the second possible path, the flow would bypass most of the U-shaped path 185. The volatile fluid would likely still include fuel vapor, as the flow would not pass through enough of the filter media 230 to remove all the fuel vapor. The volatile fluid, once at the carburetor 25 would be substantially free to escape from the air cleaner assembly 20, along with the fuel vapor, when the engine 10 is not running.

To increase the likelihood that the flow will follow the first possible flow path, the third flow path 205 is arranged to provide an increased flow resistance when compared to the fourth flow path 215. The flow resistance of the third flow path 205 can be increased using many suitable means, including flow restrictions (e.g., a small inlet aperture, an orifice, etc.), smaller tube diameter, longer tube length, and the like. The increased resistance of the third flow path results in a first possible flow path that has a flow resistance that is less than or equal to the flow resistance of the second possible flow path. Thus, the flow is more likely to follow the path of least resistance, which is the first possible path.

FIG. 10 illustrates the flow paths that are followed when the engine 10 is running. During engine operation, a partial vacuum is established between the carburetor 25 and the combustion chamber 50. The partial vacuum draws air and fuel into the combustion chamber 50 to facilitate engine operation. The third flow path 205 is exposed to this vacuum, thus, even with the increased flow resistance of the third flow path 205, fluid is drawn from the canister 135 along the third flow path 205. The first end 210 of the third flow path 205 is positioned such that the partial vacuum draws air from the U-shaped flow path 185. The air flow direction along the U-shaped flow path 185 is opposite the direction of flow when the engine 10 is not running. Thus, the air passes through the filter media 230 within the canister 135 and picks up hydrocarbons and fuel vapor that had been previously filtered by the filter media 230. The air, now laden with fuel vapor and combustible hydrocarbons, passes through the third flow path 205 to the carburetor 25, typically downstream of the throat, and from the carburetor 25 to the combustion chamber 50 for combustion. Thus, during engine operation, the filter media 230 is at least partially purged of captured hydrocarbons and fuel vapor. This arrangement allows the filter media 230 to remain unchanged for the life of the engine 10. Of course the arrangement of the canister 135 allows for the replacement of the filter media 230 if desired.

FIG. 11 illustrates the flow paths that are followed when the pressure within the tank 15 drops. Tank pressure can drop due to a reduction in temperature, or as a result of the removal of fuel during engine operation. To maintain the pressure within the tank 15, air or another fluid must flow into the tank 15. The fluid can be drawn through the fourth flow path 215 and/or the third flow path 205. When the fluid follows the fourth flow path 215, the clean air flows from the clean air space 35 through the U-shaped path 185. As the air passes through the U-shaped flow path 185 the air flow picks up fuel vapor that had previously been filtered by the filter media 230 to form an air/fuel vapor mixture. The air/fuel vapor mixture enters the second flow path 130, passes through the valve 100, and enters the fuel tank via the first flow path 110. Thus, fuel vapor that had been filtered by the filter media 230 is returned to the fuel tank 15.

Air can also follow the third flow path 205 to get into the canister 135. However, the increased flow resistance of the third flow path 205 as compared to the fourth flow path 215 makes it more likely that the air will enter the canister 135 via the fourth flow path 215.

Figure 13:
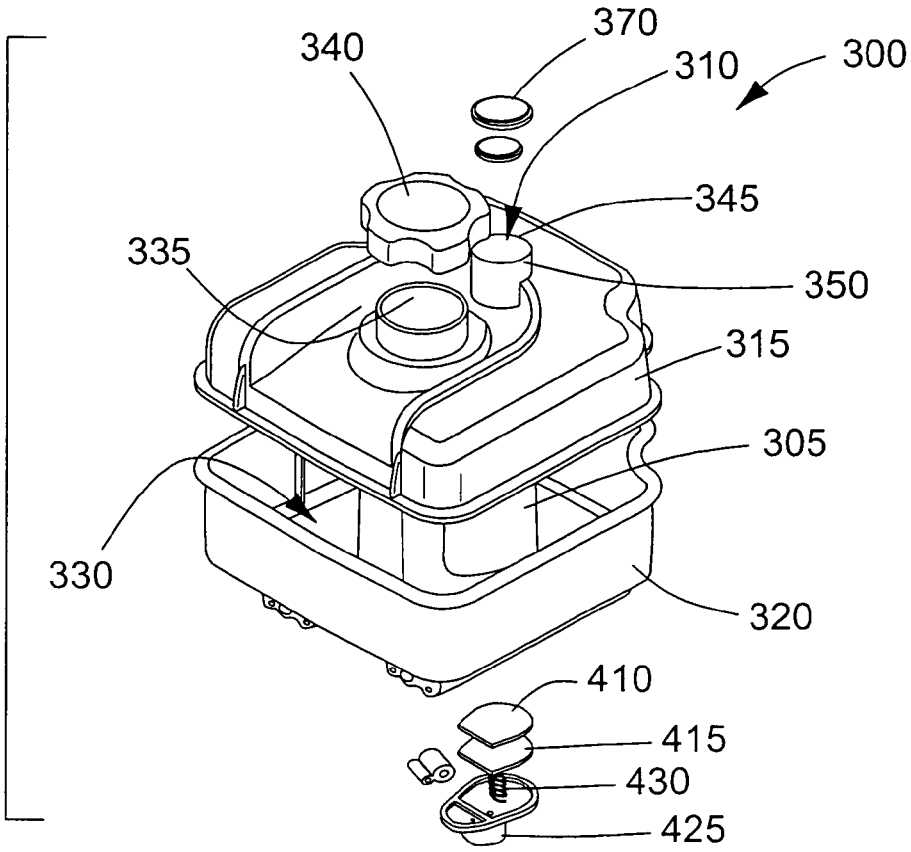
FIG. 13 is an exploded perspective view of the fuel tank of FIG. 12.

FIGS. 12–17 illustrate another construction of a fuel tank 300 that includes an integrated canister 305 and a valve chamber 310. As illustrated in FIG. 13, the fuel tank 300 includes a first or upper portion 315 and a second or lower portion 320 that connect to one another along a seam 325 to define a fuel space 330 sized to receive a desired quantity of fuel. In most constructions, the upper portion 315 and the lower portion 320 are welded to one another to provide a leak tight seal. However, other constructions may employ other attachment methods such as fasteners or clamps and other sealing devices such as gaskets, o-rings, and the like. In addition, some constructions may employ a seam that is not horizontal. As such, the fuel tank 300 should not be limited to the construction illustrated in FIGS. 12 and 13.

The upper portion 315 of the fuel tank 300 defines a first aperture 335 that is sized and positioned to receive fuel to fill the tank 300. A cap 340 engages the upper portion 315 adjacent the first aperture 335 to cover the aperture 335 and inhibit the entry of unwanted particles and the escape of fuel. In some constructions, a vented cap is employed to allow for the escape of fuel vapor and the entry of air into the fuel tank 300. However, preferred constructions employ a sealed cap 340 that inhibits the passage of fluids (e.g., fuel vapor, air, etc.) into or out of the fuel tank 300.

A boss 345 includes an exterior portion 350 that extends upward from the upper portion 315 such that at least a portion of the boss 345 is above a maximum fuel level within the fuel tank 300. The boss 345 also includes a lower portion 355, illustrated in FIGS. 15–17 that extends into the fuel space 330 and includes a plurality of apertures 360. The apertures 360, illustrated in FIG. 16 at least partially define a flow path 361 that provides for fluid communication between the valve chamber 310 and the fuel space 330 as will be discussed.

The valve chamber 310 is at least partially defined by the boss 345 such that the valve chamber 310 extends to the top of the boss 345. A valve 365 similar to the valve 100 shown schematically in FIGS. 7 and 8 is disposed within the valve chamber 310 and is operable to inhibit over-filling of the fuel tank 300, inhibit fuel spillage due to sloshing and splashing, and inhibit fuel spillage during high tilt angle (e.g., greater than about 30 degrees) or rollover conditions. The valve 365 also allows free fluid flow through the valve chamber 310 during normal operating conditions, as will be described with regard to FIGS. 16–17. Many commercially available valves are well suited to performing these functions.

After the valve 365 is positioned, a cover 370 attaches to the top of the boss 345 to seal the valve chamber 310 and inhibit unwanted leakage. In preferred constructions, the cover 370 is welded to the boss 345 with other attachment methods (e.g., fasteners, adhesives, clamps, etc.) also being possible.

Figure 15:
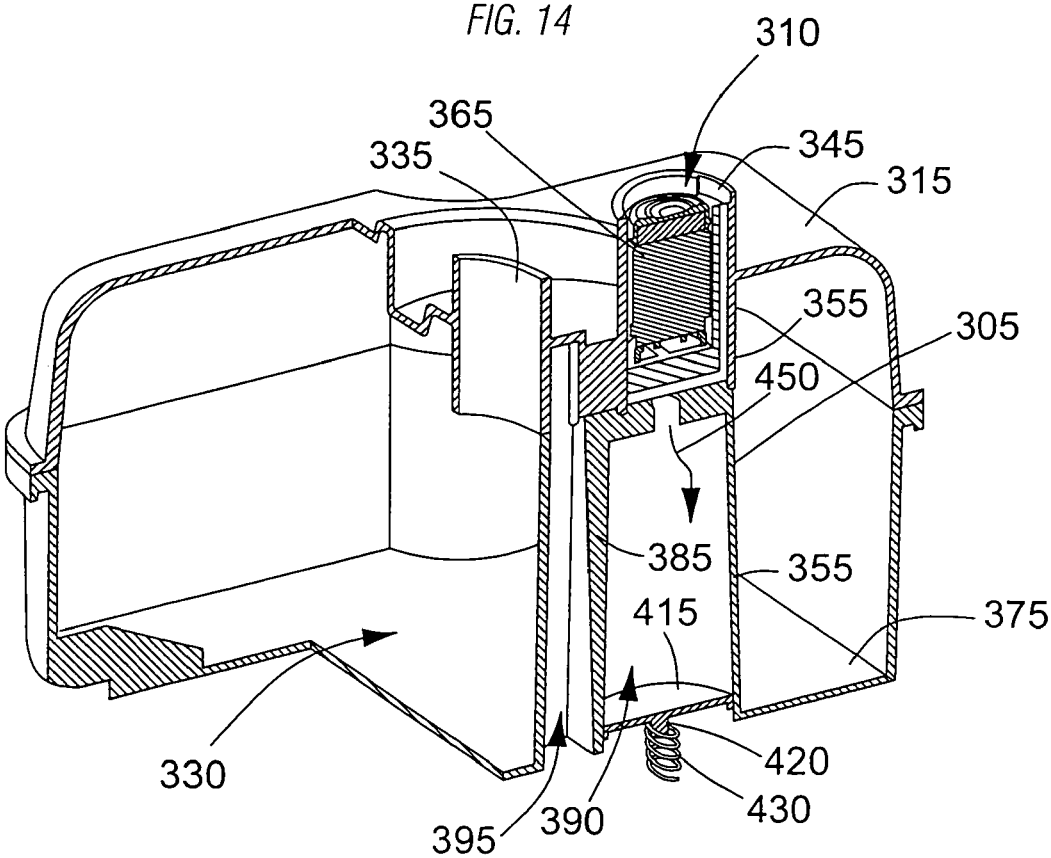
FIG. 15 is a section view of the fuel tank of FIG. 12 taken along line 15—15 of FIG. 12.
Figure 16:
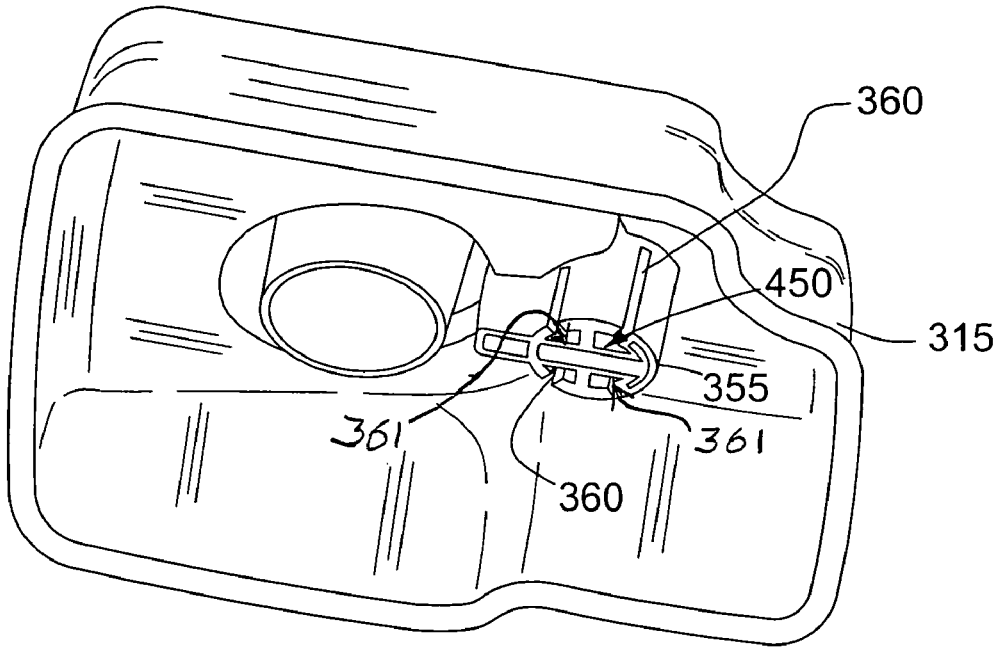
FIG. 16 is a perspective view of a top portion of the fuel of FIG. 12.

As illustrated in FIG. 15, the canister 305 extends upward from an inner surface 375 of the lower portion 320 to a level that allows the top of the canister 305 to contact and attach to the lower portion 355 of the boss 345 when the upper portion 315 and lower portion 320 of the fuel tank 300 are attached to one another. The canister 305 includes a substantially hollow space that is open at the bottom surface of the lower portion 320 of the fuel tank 300.

Figure 14:
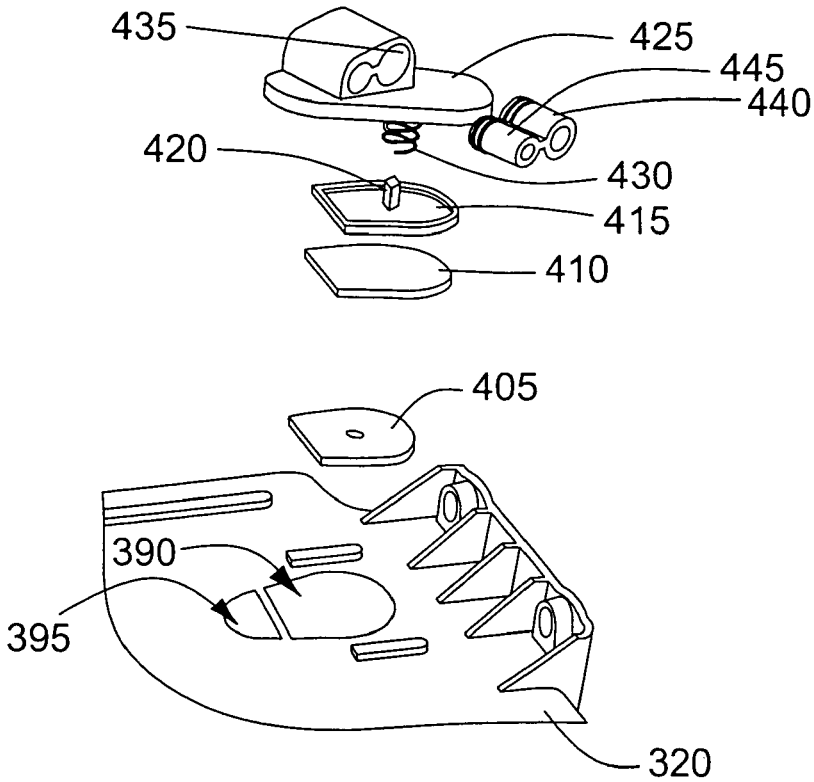
FIG. 14 is a perspective view of a portion of the fuel tank of FIG. 13.

As illustrated in FIG. 14, a wall 385 is positioned within the hollow space to divide the space 380 into a media space 390 and a purge space 395. A filter media (not shown) suitable for use in filtering hydrocarbons (e.g., activated charcoal, carbon, and the like) is positioned within the media space 390. A first plate 405 and a second plate 410 may be positioned on either end of the filter media to hold the filter media in a desired position and inhibit the movement of filter media particles into small openings or flow paths where the filter media may clog the flow paths. A piston 415 is positioned below the second plate 410 to support the filter media and the plates 405, 410. The piston 415 includes an extension 420 that extends away from the filter media 400 and toward the open end of the canister 305. A cover plate 425 attaches to the lower portion 320 of the fuel tank 300 to close the open end of the canister 305. In most constructions, the cover plate 425 is welded to the lower portion 320 with other constructions employing other attachment systems (e.g., adhesive, fasteners, etc.). A biasing member in the form of a spring 430 engages the cover plate 425 and the extension 420 to bias the filter media upward, away from the cover plate 425. The biasing member 430 maintains a desired level of compression on the filter media such that the space occupied by the filter media can expand and contract slightly without significantly changing the resistance to flow through the filter media.

The cover plate 425 includes a tube space 435 that receives two tube connections. A first aperture (not shown) provides fluid communication between a first tube connection 440 and the media space 390, and a second aperture (not shown) provides fluid communication between a second tube connection 445 and the purge space 395. A first passageway, similar to passageway 270 shown in FIG. 2, provides fluid communication between a clean air side of an air cleaner and the first tube connection 440, and a second passageway, similar to passageway 265 shown in FIG. 2, provides fluid communication between the air-fuel mixing device and the second tube connection 445. As one of ordinary skill will realize, the passageways may be formed or partially formed as part of the engine components (e.g., fuel tank, air cleaner, air-fuel mixing device, etc.), or may be formed or partially formed using tubes, pipes, or other conduits that direct fluid along a path.

Figure 17:
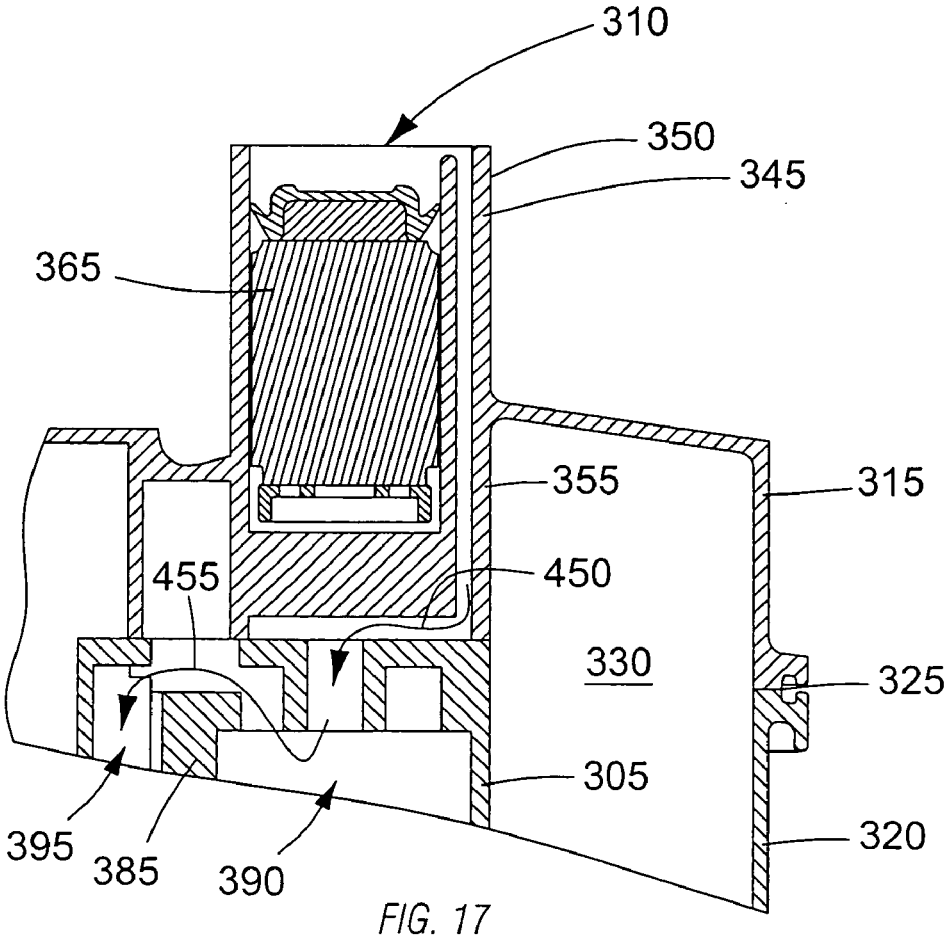
FIG. 17 is a section view of the fuel tank of FIG. 12 taken along line 17—17 of FIG. 12.

With reference to FIG. 17, fluid (generally a combination of air and fuel vapor) that passes from the fuel space 330 into the valve chamber 310 along the flow path 361 is free to flow downward along a first flow path 450 into the media space 390 of the canister 305. As the fluid passes through the filter media, a portion of the fuel vapor is removed from the fluid. As such, fluid passing from the canister 305 to the air cleaner via the first passageway is air that is largely free of fuel vapor. From the air cleaner, the air is free to exit the air cleaner. During certain operating conditions, air may be drawn into the fuel space 330 from the air cleaner. This air passes through the filter media in a direction substantially opposite the first flow path 450. The air may collect fuel vapor from the filter media as the air flows through the filter media and enters the fuel space 330.

During engine operation, the air-fuel mixing device draws fluid from the fuel space 330 and from the purge space 395 via the second tube connection 445. Fuel vapor that enters the valve chamber 310 via the flow path 361 is drawn into the purge space 395 along a second flow path 455. In addition, air is drawn through the air cleaner and through the filter media to the purge space 395. As the air passes through the filter media, fuel vapor mixes with and flows with the air. From the purge space 395, the fuel vapor and air passes to the air-fuel mixing device and into the engine for combustion.

As one of ordinary skill in the art will realize, the function of the fuel tank 300 of FIGS. 12–17 is similar to the function of the fuel tanks of FIGS. 1–11. As such, additional details regarding the function of the fuel tank 300 may be found in the description provided with regard to FIGS. 1–11.

Although the invention has been described in detail with reference to certain preferred embodiments, variations and modifications exist within the scope and spirit of the invention as described and defined in the following claims.

What is claimed is:

1. A fuel tank for an engine that includes an air cleaner assembly and an air-fuel mixing device, the fuel tank comprising:

a first tank portion;

a second tank portion connected to the first tank portion to define a fuel chamber;

a canister at least partially formed as part of the second tank portion;

a first flow path at least partially formed as part of the first tank portion, the first flow path providing fluid communication between the fuel chamber and the canister; and a second flow path at least partially formed as part of the second tank portion to provide two-way fluid communication between the canister and at least one of the air-fuel mixing device and the air cleaner assembly.

2. The fuel tank of claim 1, further comprising a valve chamber at least partially formed as part of the first tank portion, the valve chamber at least partially defining the first flow path.

3. The fuel tank of claim 2, further comprising a valve disposed substantially within the valve chamber.

4. The fuel tank of claim 1, wherein at least a portion of the valve chamber extends above the first tank portion.

5. The fuel tank of claim 1, wherein the canister includes a canister space that is at least partially filled with a filter media.

6. The fuel tank of claim 5, wherein the filter media includes a hydrocarbon adsorbent substance.

7. The fuel tank of claim 1, further comprising a purge path that provides fluid communication between the canister and an air-fuel mixing device.

8. The fuel tank of claim 7, wherein the purge path is at least partially formed as part of the second tank portion.

9. A fuel tank comprising:

a first tank portion;

a second tank portion connected to the first tank portion to define a fuel chamber;

a valve chamber at least partially formed as part of the first tank portion;

a valve member disposed at least partially within the valve chamber;

a canister at least partially formed as part of the second tank portion; and a filter media positioned within the canister and operable to adsorb fuel vapor.

10. The fuel tank of claim 9, wherein the valve chamber is in fluid communication with the fuel chamber.

11. The fuel tank of claim 9, wherein the canister is in fluid communication with the valve chamber.

12. The fuel tank of claim 9, further comprising a purge passageway at least partially formed as part of the second tank portion to provide fluid communication between the canister and an air-fuel mixing device.

13. The fuel tank of claim 9, further comprising a vent passageway at least partially formed as part of the second tank portion to provide fluid communication between the canister and an air cleaner assembly.

14. The fuel tank of claim 9, wherein the filter media includes a hydrocarbon adsorbent substance.

15. The fuel tank of claim 14, wherein the valve includes a vent valve and an overfill/tip valve.

16. The fuel tank of claim 9, wherein the first tank portion is welded to the second tank portion to define a seam therebetween.

17. A fuel tank for an engine that includes an air cleaner assembly and an air-fuel mixing device, the fuel tank comprising:

a wall defining a fuel chamber;

a valve chamber at least partially formed as part of the wall;

a first fluid communication path at least partially formed as part of the wall to provide fluid communication between the fuel chamber and the valve chamber;

a canister at least partially defining a canister space;

a second fluid communication path positioned to provide fluid communication between the valve chamber and the canister space;

a third fluid communication path at least partially formed as part of the wall to provide fluid communication between the canister space and the air-fuel mixing device; and a fourth fluid communication path at least partially formed as part of the wall to provide fluid communication between the canister space and the air cleaner assembly.

18. The fuel tank of claim 17, further comprising a valve disposed substantially within the valve chamber.

19. The fuel tank of claim 18, wherein the valve includes a vent valve and an overfill/tip valve.

20. The fuel tank of claim 17, wherein at least a portion of the canister is integrally formed as part of the wall.

21. The fuel tank of claim 17, wherein the canister space is at least partially filled with a filter media.

22. The fuel tank of claim 21, wherein the filter media includes a hydrocarbon adsorbent substance.

23. The fuel tank of claim 17, wherein the canister includes an opening that provides access to the canister space from outside of the fuel tank when the fuel tank is assembled.

24. The fuel tank of claim 23, further comprising a cover attached to the canister to sealably cover the opening.

* * * * *